US007965265B2

(12) United States Patent
Lee

(10) Patent No.: US 7,965,265 B2
(45) **Date of Patent: *Jun. 21, 2011**

(54) ORGANIC LIGHT EMITTING DISPLAY DEVICE AND DRIVING METHOD THEREOF

(75) Inventor: Wook Lee, Suwon (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 908 days.

This patent is subject to a terminal disclaimer.

(21) Appl. No.: 11/861,130

(22) Filed: Sep. 25, 2007

(65) Prior Publication Data

US 2008/0186265 A1 Aug. 7, 2008

(30) Foreign Application Priority Data

Feb. 5, 2007 (KR) ..... 10-2007-0011786

(51) Int. Cl.
*G09G 3/30* (2006.01)

(52) U.S. Cl. ..... 345/77; 345/82; 345/76

(58) Field of Classification Search ..... 345/36, 345/38–39, 42, 45–48, 50–51, 76–77, 81, 345/83–84, 87–90, 204, 207, 214, 690, 697–698; 315/169.3

See application file for complete search history.

(56) References Cited

U.S. PATENT DOCUMENTS

| | | | | |
|---|---|---|---|---|
| 5,754,150 | A * | 5/1998 | Matsui | 345/89 |
| 6,987,787 | B1 * | 1/2006 | Mick | 372/29.021 |
| 7,557,788 | B1 * | 7/2009 | Orlando et al. | 345/89 |
| 7,656,383 | B2 * | 2/2010 | Hedrick | 345/102 |
| 7,679,602 | B2 * | 3/2010 | Owyeung et al. | 345/156 |
| 7,782,279 | B2 * | 8/2010 | Lee et al. | 345/82 |
| 7,808,459 | B2 * | 10/2010 | Lee et al. | 345/77 |
| 2005/0057191 | A1 * | 3/2005 | Jo et al. | 315/291 |
| 2005/0057581 | A1 * | 3/2005 | Horiuchi et al. | 345/690 |
| 2006/0125767 | A1 | 6/2006 | Kang et al. | |
| 2006/0244387 | A1 | 11/2006 | Park et al. | |
| 2006/0262109 | A1 | 11/2006 | Park et al. | |
| 2007/0146302 | A1 * | 6/2007 | Liu et al. | 345/102 |
| 2008/0204438 | A1 * | 8/2008 | Song et al. | 345/207 |
| 2008/0246699 | A1 * | 10/2008 | Oh | 345/76 |
| 2009/0166510 | A1 * | 7/2009 | Park et al. | 250/205 |

* cited by examiner

FOREIGN PATENT DOCUMENTS

| | | |
|---|---|---|
| KR | 10-2006-0007972 | 1/2006 |
| KR | 10-2006-0112997 A | 11/2006 |
| KR | 10-2006-0113009 | 11/2006 |

OTHER PUBLICATIONS

Korean Patent Abstracts, Publication No. 10-2006-0112997, dated Nov. 2, 2006 in the name of Young Jong Park et al. Korean Office action dated Feb. 20, 2008, for priority Korean application 10-2007-0011786, with English translation indicating relevance of KR reference listed in the May 7, 2008 IDS.

*Primary Examiner* — Quan-Zhen Wang
*Assistant Examiner* — Mansour M Said
(74) *Attorney, Agent, or Firm* — Christie, Parker & Hale, LLP

(57) ABSTRACT

An organic light emitting display device including: an optical sensor for generating an optical sensor signal corresponding to brightness of ambient light; a first luminance control unit for providing a first luminance control signal (Vc1) for controlling a pulse width of a light emission control signal in accordance with the optical sensor signal; a second luminance control unit for providing a second luminance control signal (Vc2) for controlling the pulse width of the light emission control signal in accordance with data of one frame of the image; and a comparator/selector for comparing the first luminance control signal with the second luminance control signal and for selecting one of the first luminance control signal or the second luminance control signal for output to a scan driver.

20 Claims, 5 Drawing Sheets

435

| SD | EW1(Hsync) |
|---|---|
| 00 | 109 |
| 01 | 181 |
| 10 | 253 |
| 11 | 325 |

FIG. 6

635

| Upper 5-bit value (Control data) | Light emitting rate | Light emitting ratio | luminance | EW2(Hsync) |
|---|---|---|---|---|
| 0 | 0% | 100% | 300 | 325 |
| 1 | 4% | 100% | 300 | 325 |
| 2 | 7% | 100% | 300 | 325 |
| 3 | 11% | 100% | 300 | 325 |
| 4 | 14% | 100% | 300 | 325 |
| 5 | 18% | 99% | 298 | 322 |
| 6 | 22% | 98% | 295 | 320 |
| 7 | 25% | 95% | 285 | 309 |
| 8 | 29% | 92% | 275 | 298 |
| 9 | 33% | 88% | 263 | 284 |
| 10 | 36% | 83% | 250 | 271 |
| 11 | 40% | 79% | 237 | 257 |
| 12 | 43% | 75% | 224 | 243 |
| 13 | 47% | 70% | 209 | 226 |
| 14 | 51% | 64% | 193 | 209 |
| 15 | 54% | 61% | 182 | 197 |
| 16 | 58% | 57% | 170 | 184 |
| 17 | 61% | 53% | 160 | 173 |
| 18 | 65% | 50% | 150 | 163 |
| 19 | 69% | 48% | 143 | 155 |
| 20 | 72% | 45% | 136 | 147 |
| 21 | 76% | 43% | 130 | 141 |
| 22 | 79% | 41% | 124 | 134 |
| 23 | 83% | 40% | 119 | 128 |
| 24 | 87% | 38% | 113 | 122 |
| 25 | 90% | 36% | 109 | 118 |
| 26 | 94% | 35% | 104 | 113 |
| 27 | 98% | 34% | 101 | 109 |
| 28 | – | – | – | – |
| 29 | – | – | – | – |
| 30 | – | – | – | – |
| 31 | – | – | – | – |

ORGANIC LIGHT EMITTING DISPLAY DEVICE AND DRIVING METHOD THEREOF

CROSS-REFERENCE TO RELATED APPLICATION

This application claims priority to and the benefit of Korean Patent Application No. 10-2007-0011786, filed on Feb. 5, 2007, in the Korean Intellectual Property Office, the entire content of which is incorporated herein by reference.

BACKGROUND

1. Field of the Invention

The present invention relates to an organic light emitting display device and a driving method thereof.

2. Discussion of Related Art

In recent years, various flat panel displays, which have reduced weight and volume compared to cathode ray tubes, have been developed. In particular, organic light emitting diode display devices have attracted public attention, because the organic light emitting diode display devices have an excellent luminance and color purity since organic compounds are used as light emission material.

Such an organic light emitting display device is expected to be effectively used for portable display devices and the like, since it is thin and lightweight and driven at a low electric power.

However, conventional organic light emitting display devices emit light with a constant luminance regardless of surrounding brightness, and therefore their visibility is varied according to the surrounding brightness even if an image is displayed with the same gray levels. For example, an image, which is displayed when the surrounding brightness is high, has a reduced visibility, compared to an image displayed when the surrounding brightness is low.

Also, in conventional organic light emitting display devices, the amount of electric current that flows to a display area increases as the number of pixels that emit the light during one frame period increases. Further, if there are pixels among the light-emitting pixels, that display high gray levels, a larger amount of electric current flows to the display area, resulting in increased power consumption.

SUMMARY OF THE INVENTION

Aspects of embodiments of the present invention are directed an organic light emitting display device capable of controlling a luminance according to brightness of ambient light and data of one frame, reducing power consumption, and/or preventing an excessive reduction of luminance, and a driving method thereof.

An exemplary embodiment of the present invention provides an organic light emitting display device for displaying an image and having a plurality of scan lines, a plurality of light emission control lines and a plurality of data lines. The organic light emitting display includes: a display area including a plurality of pixels coupled to the scan lines, the light emission control lines and the data lines; a scan driver electrically coupled to the display area through the scan lines and the light emission control lines; a data driver electrically coupled to the display area through the data lines; an optical sensor for generating an optical sensor signal corresponding to brightness of ambient light; a first luminance control unit for providing a first luminance control signal for controlling a pulse width of a light emission control signal in accordance with the optical sensor signal; a second luminance control unit for providing a second luminance control signal for controlling the pulse width of the light emission control signal in accordance with data of one frame of the image; and a comparator/selector for comparing the first luminance control signal with the second luminance control signal and for selecting one of the first luminance control signal or the second luminance control signal for output to the scan driver.

In one embodiment, the comparator/selector is adapted to select the one of the first luminance control signal or the second luminance control signal that reduces a luminance of the display area more.

In one embodiment, when the second luminance control signal is for setting a luminance of the display area to a lower brightness level than the first luminance control signal is for setting the luminance of the display area, the comparator/selector is adapted to supply to the scan driver the second luminance control signal and to supply to the first luminance control unit a first selection signal for controlling the first luminance control unit to be turned off.

In one embodiment, when the first luminance control signal is for setting a luminance of the display area to a lower brightness level than the second luminance control signal is for setting the luminance of the display area, the comparator/selector is adapted to supply to the scan driver the first luminance control signal and to supply to the second luminance control unit a second selection signal for controlling the second luminance control unit to be turned off.

In one embodiment, the first luminance control unit includes: an analog/digital converter for converting the optical sensor signal, which is an analog signal, into a digital sensor signal; a first lookup table for storing information of a width of a first brightness control signal corresponding to the digital sensor signal; a first controller for extracting the information of the width of the first brightness control signal, corresponding to the digital sensor signal, from the first lookup table; and a first luminance control signal generation unit for generating the first luminance control signal in accordance with the information of the width of the first brightness control signal extracted from the first controller. The width of the first brightness control signal may be set so that a luminance of the display area is reduced when the digital sensor corresponds to a dark brightness level of the ambient light. The first luminance control unit may further include a first switch unit for transmitting the optical sensor signal, supplied from the optical sensor, to the analog/digital converter, or interrupting transmission of the optical sensor signal to the analog/digital converter according to the first selection signal supplied from the comparator/selector.

In one embodiment, the second luminance control unit includes: a data sum-up unit for summing up the data of one frame to generate sum-up data and for generating, as control data, at least two bit values including most significant bits of the sum-up data; a second lookup table for storing information of a width of a second brightness control signal corresponding to the control data; a second controller for extracting the information of the width of the second brightness control signal corresponding to the control data from the second lookup table; and a second luminance control signal generation unit for generating the second luminance control signal in accordance with the information of the width of the second brightness control signal extracted from the second controller. The width of the second brightness control signal may be set so that a luminance of the display area is decreased with an increase in value of the control data. The second luminance control unit may further include a second switch unit for transmitting the data of one frame to the data sum-up unit or interrupting transmission of the data to the data sum-up unit according to the second selection signal supplied from the comparator/selector.

Another exemplary embodiment of the present invention provides a method for driving an organic light emitting display device having a display area comprising a plurality of pixels. The method includes: generating an optical sensor signal corresponding to brightness of ambient light; generating a first luminance control signal for controlling a pulse width of a light emission control signal in accordance with the optical sensor signal; generating a second luminance control signal for controlling the pulse width of the light emission control signal in accordance with data of one frame of an image; comparing the first luminance control signal with the second luminance control signal: and selecting one of the first luminance control signal or the second luminance control signal to control a luminance of the display area.

In one embodiment, the method further includes controlling the luminance of the display area in accordance with the selected one of the first luminance control signal or the second luminance control signal, wherein the selecting the one of the first luminance control signal or the second luminance control signal to control the luminance of the display area includes selecting the one of the first luminance control signal or the second luminance control signal that reduces the luminance of the display area more.

In one embodiment, the generating the first luminance control signal includes: converting the optical sensor signal into a digital sensor signal; extracting information of a width of a first brightness control signal corresponding to the digital sensor signal; and generating the first luminance control signal in accordance with the extracted information of the width of the first brightness control signal.

In one embodiment, the generating the second luminance control signal includes: summing up the data of one frame to generate sum-up data; generating control data corresponding to the sum-up data; extracting information a width of a second brightness control signal corresponding to the control data; and generating the second luminance control signal in accordance with the extracted information of the width of the second brightness control signal.

Another exemplary embodiment of the present invention provides an organic light emitting display device for displaying an image and having a plurality of scan lines, a plurality of light emission control lines and a plurality of data lines. The organic light emitting display includes: a display area including a plurality of pixels coupled to the scan lines and the light emission control lines; a scan driver electrically coupled to the display area through the scan lines and the light emission control lines; an optical sensor for generating an optical sensor signal corresponding to brightness of ambient light; a comparator/selector for comparing a first luminance control signal with a second luminance control signal and for selecting one of the first luminance control signal or the second luminance control signal for output to the scan driver; a first luminance control unit for providing to the comparator/selector the first luminance control signal for controlling a pulse width of a light emission control signal in accordance with the optical sensor signal; and a second luminance control unit for providing to comparator/selector the second luminance control signal for controlling the pulse width of the light emission control signal in accordance with data of one frame of the image.

In one embodiment, the comparator/selector is adapted to select the one of the first luminance control signal or the second luminance control signal that reduces a luminance of the display area more.

BRIEF DESCRIPTION OF THE DRAWINGS

These and/or other aspects and features of the invention will become apparent and more readily appreciated from the following description of the exemplary embodiments, taken in conjunction with the accompanying drawings of which:

FIG. 6 is an exemplary embodiment of a table illustrating values of a second lookup table shown in FIG. 5.

DESCRIPTION OF MAJOR PARTS IN THE FIGURES

Figure 1:
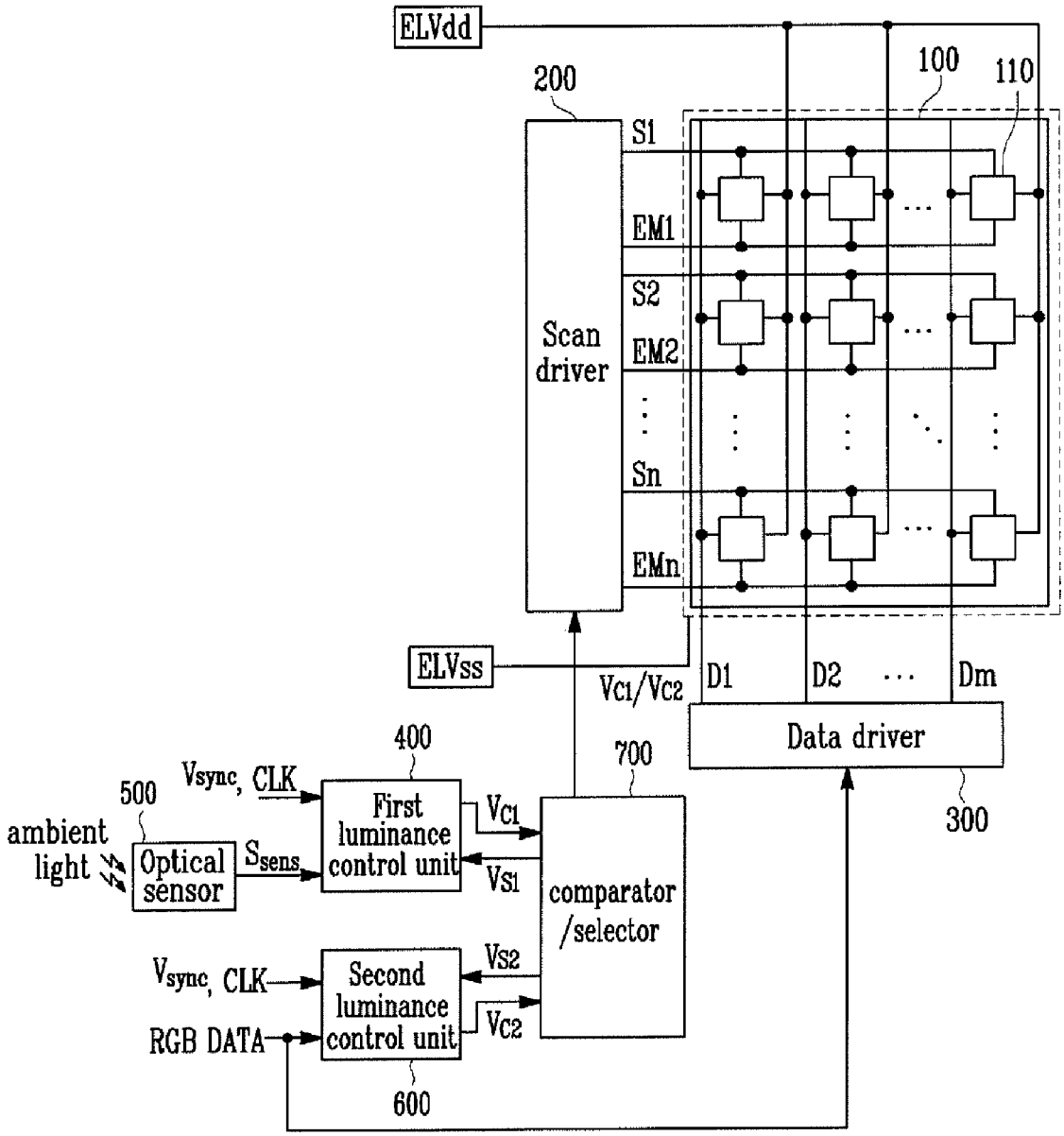
FIG. 1 is a block diagram showing a configuration of an organic light emitting display device according to one exemplary embodiment of the present invention.

| | |
|---|---|
| 100: display area | 200: scan driver |
| 300: data driver | 400: first luminance control unit |
| 500: optical sensor | 600: second luminance control unit |
| 700: comparator/selector | |

DETAILED DESCRIPTION OF EMBODIMENTS

Hereinafter, exemplary embodiments according to the present invention will be described with reference to the accompanying drawings. Here, when one element is referred to as being connected to another element, one element may be not only directly connected to the another element but instead may be indirectly connected to the another element via one or more other elements. Further, some of the elements that are not essential to the complete description of the invention have been omitted for clarity. Also, like reference numerals refer to like elements throughout.

Exemplary embodiments according to the present invention provide an organic light emitting display device capable of controlling luminance according to brightness of ambient light and data of one frame. The embodiments of the present invention may result in reduced power consumption.

If the brightness of the ambient light and the luminance corresponding to data of one frame are both employed to reduce or limit a luminance of a display area, then the luminance of the display area may be excessively reduced, resulting in deteriorated visibility. Therefore, in an exemplary embodiment according the present invention, when the brightness level of the ambient light is below a reference level (e.g., a predetermined or preset brightness level), the data of one frame is not used to further reduce or limit the luminance of the display area.

FIG. 1 is a block diagram showing a configuration of an organic light emitting display device according to one exemplary embodiment of the present invention.

Referring to FIG. 1, the organic light emitting display device according to one embodiment of the present invention includes a display area 100, a scan driver 200, a data driver 300, a first luminance control unit 400, an optical sensor 500, a second luminance control unit 600 and a comparator/selector 700.

The display area 100 includes a plurality of pixels 110 connected to scan lines (S1 to Sn), light emission control lines (EM1 to EMn) and data lines (D1 to Dm). Here, one pixel 110 has at least one organic light emitting diode and may be composed of at least two subpixels which emit lights having different colors, each subpixel having one organic light emitting diode having a corresponding color.

The display area 100 displays an image in accordance with a first power source (ELVdd) and a second power source (ELVss) supplied from the outside; a scan signal and a light emission control signal supplied from the scan driver 200; and a data signal supplied from the data driver 300.

The scan driver 200 is electrically connected with the display area 100 through the scan lines (S1 to Sn) and the light emission control lines (EM1 to EMn). The scan driver 200 generates the scan signal and the light emission control signal. The scan signal generated in the scan driver 200 is sequentially supplied to each of the scan lines (S1 to Sn), and the light emission control signal is sequentially supplied to each of the light emission control lines (EM1 to EMn).

Here, a pulse width of the light emission control signal generated in the scan driver 200 is controlled by using a first luminance control signal and/or a second luminance control signal (Vc1, Vc2) when the first luminance control signal and/or the second luminance control signal (Vc1, Vc2) is(are) supplied from the comparator/selector 700. A light emission time of the pixels 110 is varied according to the changes in the pulse width of the light emission control signal as described above, resulting in adjustment of the entire brightness of the display area 100.

The data driver 300 is electrically connected with the display area 100 through the data lines (D1 to Dm). The data driver 300 generates a data signal corresponding to image data (RGB Data) inputted thereinto during one frame period. The data signal generated in the data driver 300 is supplied to the data lines (D1 to Dm), and then supplied to each of the pixels 110 in synchronization with the scan signal.

The first luminance control unit 400 generates a first luminance control signal (Vc1) for controlling a pulse width of the light emission control signal in accordance with an optical sensor signal (Ssens) supplied from the optical sensor 500, and outputs the generated first luminance control signal (Vc1) into the comparator/selector 700.

More particularly, the first luminance control unit 400 selects the pulse width of the light emission control signal according to control signals, supplied from the outside (such as the vertical synchronizing signal (Vsync) and the clock signal (CLK)), and the optical sensor signal (Ssens) supplied from the optical sensor 500; and outputs the first luminance control signal (Vc1) corresponding to the selected pulse width of the light emission control signal.

The first luminance control unit 400 is set to an ON or OFF state according to a first selection signal (Vs1) supplied from the comparator/selector 700. For example, in one embodiment, the first luminance control unit 400 outputs the first luminance control signal (Vc1) corresponding to the optical sensor signal (Ssens) if the first selection signal (Vs1) for directing the first luminance control unit 400 to be "on" is inputted into the first luminance control unit 400, and outputs a previously set standard gamma signal (Vn) if the first selection signal (Vs1) for directing the first luminance control unit 400 to be "off" is inputted.

The optical sensor 500 has an optical sensor element, such as a transistor or photodiode, to sense brightness of external light, namely the ambient light, and generates the optical sensor signal (Ssens) to correspond to the brightness of the ambient light. The optical sensor signal (Ssens) generated in the optical sensor 500 is supplied to the first luminance control unit 400.

The second luminance control unit 600 generates a second luminance control signal (Vc2) for controlling the pulse width of the light emission control signal in accordance with the data (RGB Data) of one frame, and outputs the generated second luminance control signal (Vc2) into the comparator/selector 700.

In one exemplary embodiment, the second luminance control unit 600 selects the pulse width of the light emission control signal in accordance with a sum-up value of the data (RGB Data) supplied to the second luminance control unit 600 during one frame period, a synchronizing signal (Vsync) and a clock signal (CLK); generates the second luminance control signal (Vc2) corresponding to the selected pulse width of the light emission control signal; and outputs the generated second luminance control signal (Vc2).

The second luminance control unit 600 is controlled so that it can be turned on or off according to a second selection signal (Vs2) supplied from the comparator/selector 700. For example, in one embodiment, the second luminance control unit 600 is set so that it can output the second luminance control signal (Vc2) corresponding to the sum-up value of the data of one frame if the second selection signal (Vs2) for directing the second luminance control unit 600 to be on is inputted into the second luminance control unit 600, and is set so that it cannot output the second luminance control signal (Vc2) if the second selection signal (Vs2) for directing the second luminance control unit 600 to be off is inputted.

The comparator/selector 700 compares the first luminance control signal (Vc1) supplied from the first luminance control unit 400 with the second luminance control signal (Vc2) supplied from the second luminance control unit 600, and outputs one of them (i.e., one of the first luminance control signal (Vc1) or the second luminance control signal (Vc2)) to the scan driver 200, and, in one embodiment, the outputted luminance control signal is the luminance control signal that reduces a luminance of the display area 100 relatively more.

More particularly, the comparator/selector 700 may compare a pulse width of a light emission control signal controlled by the first luminance control signal (Vc1) with a pulse width of a light emission control signal controlled by the second luminance control signal (Vc2), select the one of the first luminance control signal or the second luminance control signal (Vc1/Vc2) that reduces a light emission time of the pixels 110 more, and output the selected luminance control signal (Vc1/Vc2) into the scan driver 200.

For example, the comparator/selector 700 may output the first luminance control signal (Vc1) into the scan driver 200 if the first luminance control signal (Vc1) can reduce the luminance of the display area 100 more than the second luminance control signal (Vc2) can reduce the luminance of the display area 100. In this case, the comparator/selector 700 generates the second selection signal (Vs2) for directing the second luminance control unit 600 to be off, thereby reducing a power consumption, and supplies the generated second selection signal (Vs2) to the second luminance control unit 600.

By contrast, the comparator/selector 700 may output the second luminance control signal (Vc2) into the scan driver 200 if the second luminance control signal (Vc2) can reduce the luminance of the display area 100 more than the first luminance control signal (Vc1) can reduce the luminance of the display area 100. In this case, the comparator/selector 700 generates the first selection signal (Vs1) for directing the first luminance control unit 400 to be off, and supplies the generated first selection signal (Vs1) to the first luminance control unit 400.

Also, if the first luminance control signal (Vc1) and the second luminance control signal (Vc2) limit the luminance of the display area 100 on the same level, then the comparator/selector 700 selects the previously set luminance control signal out of the two luminance control signals, and outputs the selected luminance control signal into the scan driver 200. In this case, the comparator/selector 700 may direct the luminance control unit, which generates the selected luminance control signal, to be turned on, and the other luminance control unit to be turned off, or may generate selection signals (Vs1, Vs2) for turning on both of the first and second luminance control units 400, 600 and supply the generated selection signals (Vs1, Vs2) to the first and second luminance control units 400, 600.

Then, the scan driver 200 generates a light emission control signal having a pulse width corresponding to at least one of the first luminance control signal or the second luminance control signal (Vc1, Vc2) supplied to the scan driver 200, and supplies the generated light emission control signal to light emission control lines (EM1 to EMn), and therefore a luminance of the display area 100 is controlled.

However, in the organic light emitting display device, the first and second luminance control units 400, 600 may be set to be turned on when new data is inputted into a memory even after the first and/or second luminance control units 400, 600 is(are) turned off by the first and/or second selection signals (Vs1, Vs2). Therefore, the luminance of the display area 100 may be controlled in a more effective manner by suitably reflecting (or representing) a luminance value in accordance with the brightness of the ambient light and/or the data of one frame.

As described above, the organic light emitting display device may control the luminance of the display area 100 in accordance with the brightness of the ambient light and the data of one frame, and also employ the optimum driving conditions to select one of the first and second luminance control signals which reduces the luminance of the display area 100 more. If one of the brightness of the ambient light or the data of one frame is suitably selected to limit the luminance of the display area 100 without employing both the brightness of the ambient light and the data of one frame, then excessive reduction in the luminance of the display area 100 is prevented.

Also, if one of the first and second luminance control units 400, 600 is turned off, for example, if the second luminance control unit 600 is turned off by the second selection signal (Vs2) supplied from the comparator/selector 700, then unnecessary power consumption caused by overlapped operations may be prevented.

Also, if the pulse width of the light emission control signal is limited by the first or second luminance control signal (Vc1, Vc2) generated in the first or second luminance control unit 400, 600, then excessive electric current is prevented from flowing to the display area 100, resulting in a further reduction in power consumption.

Figure 2:
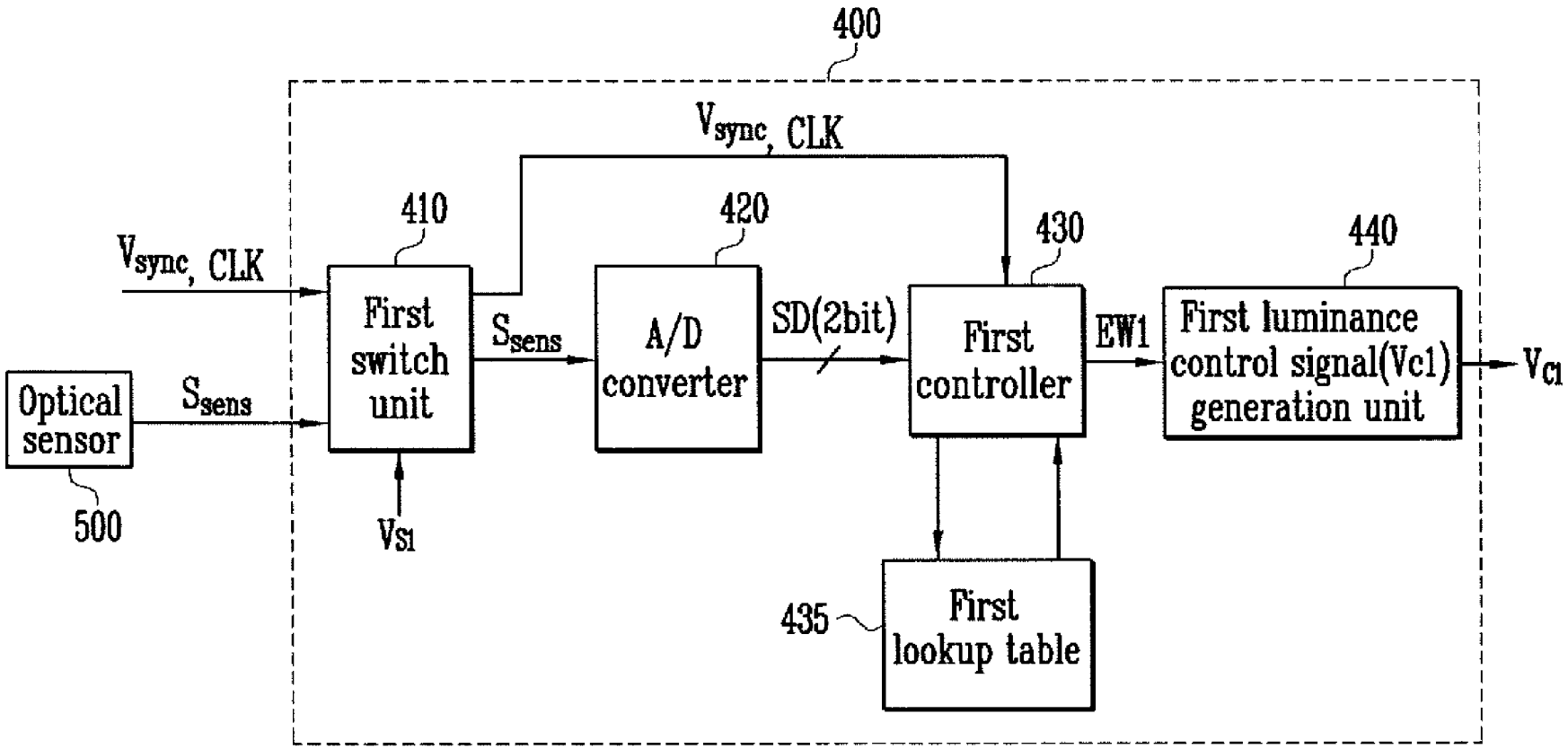
FIG. 2 is a block diagram showing one exemplary embodiment of a first luminance control unit as shown in FIG. 1.

FIG. 2 is a block diagram showing one embodiment of the first luminance control unit 400 shown in FIG. 1.

Referring to FIG. 2, the first luminance control unit 400 in one embodiment includes a first switch unit 410, an analog/digital converter 420, a first controller 430, a first lookup table 435 and a first luminance control signal (Vc1) generation unit 440.

The first switch unit 410 controls whether or not control signals, such as a synchronizing signal (Vsync) and a clock signal (CLK), and an optical sensor signal (Ssens) are supplied in accordance with the first selection signal (Vs1) supplied from the comparator/selector 700.

More particularly, the first switch unit 410 provides the optical sensor signal (Ssens), supplied from the optical sensor 500, to the analog/digital converter 420 in accordance with the first selection signal (Vs1) if the first selection signal (Vs1) directing the first luminance control unit 400 to be on is inputted, and also supplies the control signals, such as the synchronizing signal (Vsync) and the clock signal (CLK), to the first controller 430.

Also, the first switch unit 410 interrupts the transmission (or supply) of the optical sensor signal (Ssens) to the analog/digital converter 420 if the first selection signal (Vs1) directing the first luminance control unit 400 to be off is inputted, and also interrupts the transmission (or supply) of the control signals, such as the synchronizing signal (Vsync) and the clock signal (CLK), to the first controller 430.

The analog/digital converter (hereinafter, referred to as an A/D converter) 420 compares the analog optical sensor signal (Ssens), outputted from the optical sensor 500, with a reference voltage (e.g., a previously set reference voltage), and converts the analog optical sensor signal (Ssens) into a digital sensor signal (SD) corresponding to the reference voltage.

For example, in one embodiment, when the A/D converter 420 divides a surrounding brightness into four levels and outputs a 2-bit digital sensor signal (SD) according to the surrounding brightness, the A/D converter 420 may output a digital sensor signal (SD) of "11" in the brightest surrounding brightness level, and output a digital sensor signal (SD) of "10" in a relatively bright surrounding brightness level. Also, the A/D converter 420 may output a digital sensor signal (SD) of "01" in a relatively dark surrounding brightness level, and output a digital sensor signal (SD) of "00" in the darkest surrounding brightness level. The digital sensor signal (SD) outputted from the A/D converter 420 is inputted into the first controller 430.

The first lookup table 435 stores a width (EW1) information of a first brightness control signal corresponding to each of the digital sensor signals (SD). Here, the width (EW1) of the first brightness control signal is a data value having an information about the width of the light emission control signal for controlling a light emission time of the pixels 110. The width (EW1) of the first brightness control signal is set so that a luminance of the display area 100 is decreased by decreasing the light emission time of the pixels 110 as a brightness of the ambient light gets darker, that is, as the digital sensor signal (SD) becomes the digital sensor signal (SD) corresponding to a relatively dark brightness level in the brightness of the ambient light.

The first controller 430 is driven by the control signals, such as the synchronizing signal (Vsync) and the clock signal (CLK), supplied to the first controller 430 to extract a width (EW1) information of the bright control signal, corresponding to the digital sensor signal (SD) supplied from the A/D converter 420, from the first lookup table 435. The width (EW1) information of the first brightness control signal extracted by the first controller 430 is supplied to the first luminance control signal (Vc1) generation unit 440.

The first luminance control signal (Vc1) generation unit 440 generates the first luminance control signal (Vc1) corresponding to the width (EW1) information of the first brightness control signal supplied from the first controller 430, and outputs the generated first luminance control signal (Vc1) to the comparator/selector 700.

Figures 3, 4:
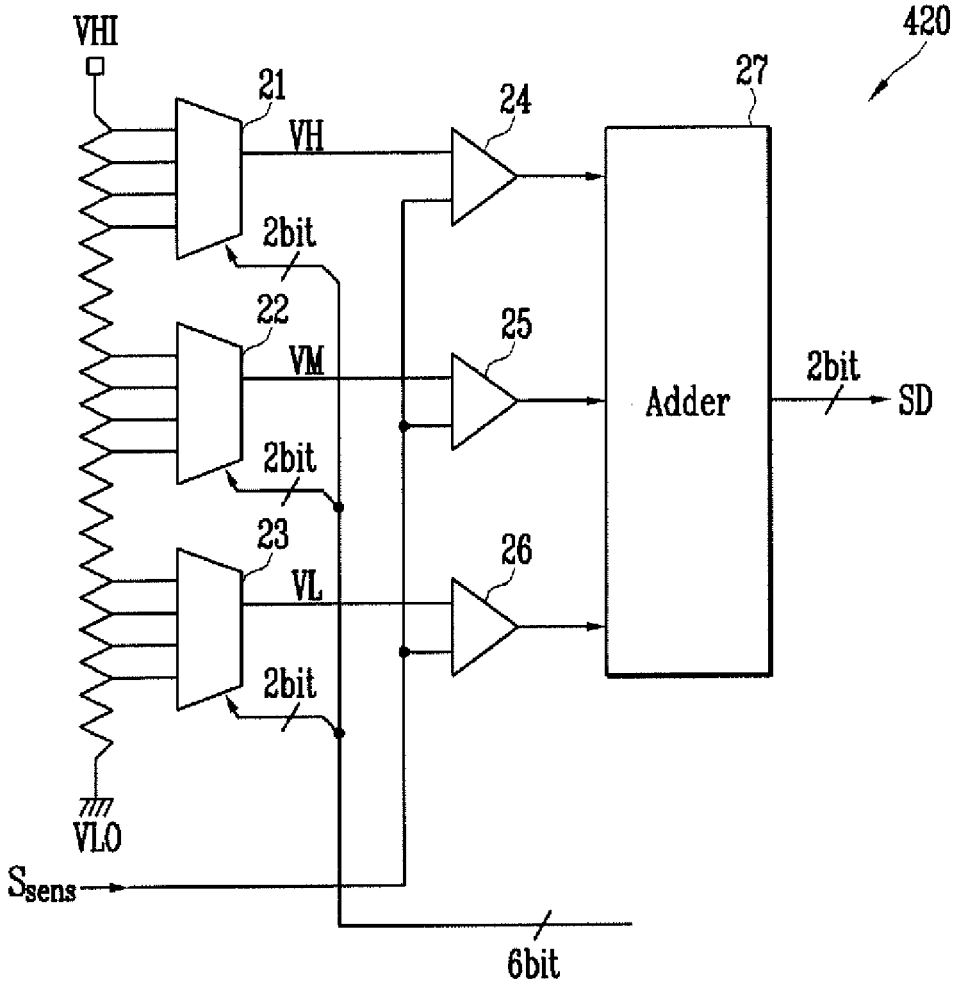
FIG. 3 is a block diagram showing one exemplary embodiment of an A/D converter shown in FIG. 2.
FIG. 4 is an exemplary embodiment of a table illustrating values of a first lookup table shown in FIG. 2.

FIG. 3 is a diagram showing one exemplary embodiment of the A/D converter shown in FIG. 2.

Referring to FIG. 3, the A/D converter 420 includes first, second and third selectors 21, 22, 23; first, second, and third comparators 24, 25, 26 and an adder 27.

The first to third selectors 21, 22, 23 receive a plurality of gray level voltages distributed through a plurality of resistance arrays for generating a plurality of gray level voltages (VHI to VHO), and outputs the gray level voltages corresponding to differently set 2-bit values, which is referred to as reference voltages (VH, VM and VL).

The first comparator 24 compares the analog optical sensor signal (Ssens) with a first reference voltage (VH) and outputs the resultant value. For example, the first comparator 24 may output "1" if an analog optical sensor signal (Ssens) is higher than a first reference voltage (VH), and "0" if an analog optical sensor signal (Ssens) is lower than a first reference voltage (VH).

In the same manner, the second comparator 25 outputs a value obtained by comparing the analog optical sensor signal (Ssens) with a second reference voltage (VM), and the third comparator 26 outputs a value obtained by comparing the analog optical sensor signal (Ssens) with a third reference voltage (VL).

Also, an area of the analog optical sensor signal (Ssens) corresponding to the same digital sensor signal (SD) may be changed by varying the first to third reference voltages (VH to VL).

The adder 27 adds up all of the resultant values outputted from the first to third comparators 24, 25, 26 and outputs the values as a 2-bit digital sensor signal (SD).

Hereinafter, an operation of the A/D converter 420 shown in FIG. 3 will be described in detail, assuming that the first reference voltage (VH) is set to 3V, the second reference voltage (VM) is set to 2V, the third reference voltage (VL) is set to 1V, and a voltage value of the analog optical sensor signal (Ssens) is increased as the ambient light becomes brighter.

If the analog optical sensor signal (Ssens) has a lower voltage than 1V, then all of the first to third comparators 24, 25, 26 output '0', and therefore the adder 27 outputs a digital sensor signal (SD) of '00'.

Also, if the analog optical sensor signal (Ssens) has a voltage between 1V and 2V, then the first to third comparators 24, 25, 26 output '0', '0', '1' respectively, and therefore the adder 27 outputs a digital sensor signal (SD) of '01'.

In the same manner, if the analog optical sensor signal (Ssens) has a voltage between 2V and 3V, then the adder 27 outputs a digital sensor signal (SD) of '10', and if the analog optical sensor signal (Ssens) has a higher voltage than 3V or more, then the adder 27 outputs a digital sensor signal (SD) of '11'.

The A/D converter 420 divides a brightness of the ambient light into four brightness levels while being driven in the above-mentioned manner, and then outputs '00' in the darkest brightness level, outputs '01' in a relatively dark brightness level, outputs '10' in a relatively bright brightness level, and outputs '11' in the brightest brightness level.

FIG. 4 is a diagram showing one example of a first lookup table shown in FIG. 2. In one exemplary embodiment, the first lookup table as shown in FIG. 4 is based on an assumption that the amount of time that an electric current flows to the pixel 110 increases as the width (EW1) of the first brightness control signal increases, and is provided for the purpose of illustrations only, and is not intended to limit the scope of the invention. That is, the content stored in the lookup table 435 may be varied by experiments, depending on the configuration of the pixel circuits, the resolution and size of the display area 100, etc.

Referring to FIG. 4, the width (EW1) of the first brightness control signal corresponding to the digital sensor signal (SD) is stored in the first lookup table 435. Here, the width (EW1) of the first brightness control signal is set so that it can be narrowed as the brightness of the ambient light becomes darker.

For example, the width (EW1) of the first brightness control signal, corresponding to the digital sensor signal (SD) of '00' which corresponds to the darkest brightness levels in the brightness of the ambient light, is set to the narrowest width, which corresponds to 109 cycles of a horizontal synchronizing signal (Hsync). Accordingly, the light emission time of the pixels 110 is reduced, and therefore the luminance of the display area 100 and power consumption are both lowered.

Also, the width (EW1) of the first brightness control signal is set so that it can be gradually increased as the brightness of the ambient light increases, and the width (EW1) of the first brightness control signal, corresponding to the digital sensor signal (SD) of '11' which corresponds to the brightest brightness level in the brightness of the ambient light. The brightest brightness level corresponds to 325 cycles of a horizontal synchronizing signal (Hsync) so as to emit the light for a sufficient period. Accordingly, depending on the brightness of the ambient light, the luminance of the display area 100 may be controlled, and the power consumption may also be reduced, and/or the reduction in the visibility of the display area 100 may be prevented.

Figure 5:
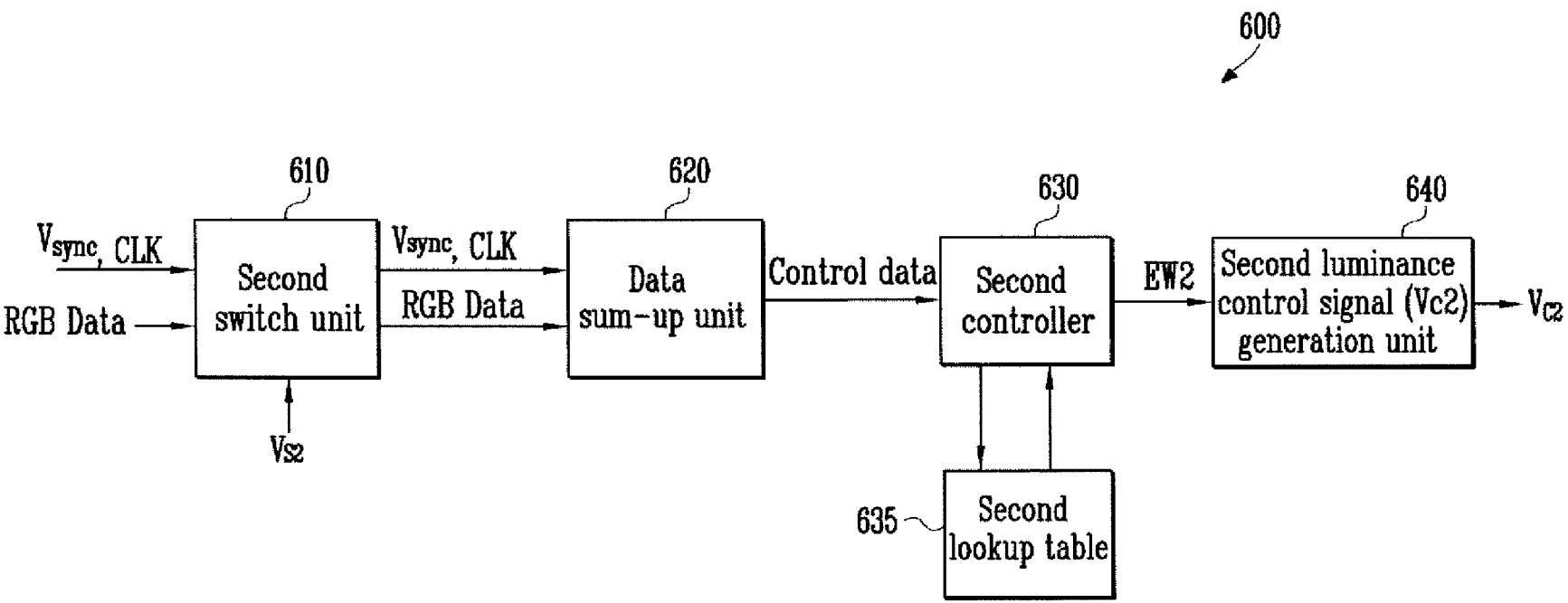
FIG. 5 is a block diagram showing one exemplary embodiment of a second luminance control unit shown in FIG. 1.

FIG. 5 is a block diagram showing one exemplary embodiment of the second luminance control unit 600 shown in FIG. 1.

Referring to FIG. 5, the second luminance control unit 600 includes a second switch unit 610, a data sum-up unit 620, a second controller 630, a second lookup table 635 and a second luminance control signal (Vc2) generation unit 640.

The second switch unit 610 controls whether or not control signals, such as a synchronizing signal (Vsync) and a clock signal (CLK), and data (RGB Data) of one frame are supplied to the data sum-up unit 620 in accordance with the second selection signal (Vs2) supplied from the comparator/selector 700.

For example, the second switch unit 610 supplies the control signals, such as the synchronizing signal (Vsync) and the clock signal (CLK), and data (RGB Data) of one frame to the data sum-up unit 620 in accordance with the second selection signal (Vs2) directing ON of the second luminance control unit 600 (or directing the second luminance control unit 600 to be on) is inputted. Further, the second switch unit 610 interrupts the supply of the control signals, such as a synchronizing signal (Vsync) and a clock signal (CLK), and data (RGB Data) of one frame to the data sum-up unit 620 in the other cases, that is, if the second selection signal (Vs2) directing OFF of the second luminance control unit 600 or directing the second luminance control unit 600 to be off) is inputted.

The data sum-up unit 620 generates sum-up data obtained by adding up image data (RGB Data) inputted during one frame period to correspond to the control signals, such as the synchronizing signal (Vsync) and the clock signal (CLK), and generates, as control data having at least two bits including the uppermost bits (i.e., the most significant bits) of the sum-up data. Hereinafter, it is assumed that an upper (i.e., most significant) 5-bit value of the sum-up data is set to the control data for the sake of convenience. Here, a high value of the sum-up data means that the data sum-up unit 620 includes a large amount of data having a high luminance more than a reference luminance (e.g., a predetermined luminance), and a low value of the sum-up data means that the data sum-up unit 620 includes a small amount of data having a high luminance more than the reference luminance (e.g., the predetermined luminance). The control data generated in the data sum-up unit 620 is transmitted to the second controller 630.

The second lookup table 635 stores a width (EW2) information of a second brightness control signal corresponding to the control data (for example, control data from 0 to 31 if the control data is set to a 5-bit value). Here, the width (EW2) information of the second brightness control signal is a data value having an information on the width of the light emission control signal for controlling a light emission time of the pixels 110, and the width (EW2) information of the second brightness control signal stored in the second lookup table 635 is set so that the luminance of the display area 100 can be reduced with an increasing value of the control data. That is, the width (EW2) information of the second brightness control signal is set to limit an electric current capacity flowing to the display area 100 by reducing a light emission time of the pixels 110 as the value of the control data increases.

The second controller 630 extracts the width (EW2) information of the second brightness control signal, corresponding to the control data supplied from the data sum-up unit 620, from the second lookup table 635, and transmits (or provides) the extracted width (EW2) information to the second luminance control signal (Vc2) generation unit 640.

The second luminance control signal (Vc2) generation unit 640 generates the second luminance control signal (Vc2) in accordance with the width (EW2) information of the second brightness control signal supplied from the second controller 630, and outputs the generated second luminance control signal (Vc2) to the comparator/selector 700.

FIG. 6 is a diagram showing one exemplary embodiment of a lookup table 635 shown in FIG. 5. The second lookup table 635 shown in FIG. 6 is based on an assumption that the amount of time that an electric current flows to the pixel 110 increases as the width (EW2) of the second brightness control signal increases, but the description proposed herein is not intended to limit the scope of the invention. In practice, the content stored in the second lookup table 635 may be varied, depending on the configuration of the pixel circuits, the resolution and size of the display area 100, etc.

Referring to FIG. 6, the width (EW2) information of the second brightness control signal corresponding to an upper 5-bit value (namely, the control data) of the sum-up data is stored in the second lookup table 635. Here, the width (EW2) information of the second brightness control signal is set so that it can be narrowed with an increasing value of the control data so as to limit a power consumption within a constant range (in other words, to limit the luminance). Here, if the control data has at least one value including the minimum value, then the width (EW2) information of the second brightness control signal is sustained at a constant width.

By way of example, if the control data is set to a value of '4' or less, the width (EW2) information of the second brightness control signal is set to a width corresponding to 325 cycles of a horizontal synchronizing signal (Hsync) so as to not limit the luminance. As described above, when the control data has at least one value including the minimum value, if the width (EW2) information of the second brightness control signal is not limited, a contrast ratio may be improved when a dark image is displayed, and therefore an image having an improved contrast may be displayed.

If the control data is set to a value of '5' or more, then the width (EW2) information of the second brightness control signal is slowly narrowed with an increasing value of the control data. As described above, if the control data has a higher value than at least one value including the minimum value, then the power consumption may be sustained within a constant range since the luminance is lowered as the width (EW2) information of the second brightness control signal gets narrower. Also, eye fatigue may be alleviated due to the limited luminance of the display area 100 even if one watches images for a long time. Actually, a ratio for limiting the luminance is increased since the increased number of pixels displaying high gray levels increases the value of the control data.

In order to prevent the excessive reduction of the luminance, a maximum limitation ratio for the luminance is defined, and therefore the pixels 110 displaying high gray levels are set to have a light emitting ratio of 34% or less even if these pixels 110 having high gray levels take a majority of an area of the display area 100. In other words, if the control data has a higher value than at least one value including the minimum value, then the width (EW2) information of the second brightness control signal should not be set to a width less than a reference width (e.g., a predetermined width). In one embodiment, the second lookup table 635 is applied to a moving image. Actually, if an image displayed in the organic light emitting display device is a still image and a moving image, the limited range of the luminance is varied according to kinds of the image. For example, in one embodiment, the maximum limitation ratio of the luminance may reach 50% in the case of the still image.

As described above, the organic light emitting display device according to exemplary embodiments of the present invention are useful to prevent the excessive reduction in the luminance by controlling the luminance of the display area to correspond to the data of one frame and/or the brightness of the ambient light, and/or by employing the optimum driving conditions to select one of the first and second luminance control signals which reduces the luminance of the display area to a larger extent.

Also, unnecessary power consumption caused by overlapping operations may be prevented if one of the first and second luminance control units is turned off.

Also, if the pulse width of the light emission control signal is limited by the first or second luminance control signal generated in the first or second luminance control unit, then excessive electric current is prevented from flowing to the display area, resulting in reduction in the power consumption.

The description provided herein is just exemplary embodiments for the purpose of illustrations only, and not intended to limit the scope of the invention, so it should be understood that other equivalents and modifications could be made thereto without departing from the spirit and scope of the invention as those skilled in the art would appreciate. Therefore, it should be understood that the present invention has a scope that is defined in the claims and their equivalents.

What is claimed is:

1. An organic light emitting display device for displaying an image and having a plurality of scan lines, a plurality of light emission control lines and a plurality of data lines, the organic light emitting display comprising:

a display area including a plurality of pixels coupled to the scan lines, the light emission control lines and the data lines;

a scan driver electrically coupled to the display area through the scan lines and the light emission control lines;

a data driver electrically coupled to the display area through the data lines;

an optical sensor for generating an optical sensor signal corresponding to brightness of ambient light;

a first luminance control unit for providing a first luminance control signal for controlling a pulse width of a light emission control signal in accordance with the optical sensor signal;

a second luminance control unit for providing a second luminance control signal for controlling the pulse width of the light emission control signal in accordance with data of one frame of the image; and a comparator/selector for comparing the first luminance control signal with the second luminance control signal and for selecting one of the first luminance control signal or the second luminance control signal for output to the scan driver.

2. The organic light emitting display device according to claim 1, wherein the comparator/selector is adapted to select the one of the first luminance control signal or the second luminance control signal that reduces a luminance of the display area more.

3. The organic light emitting display device according to claim 1, wherein, when the second luminance control signal is for setting a luminance of the display area to a lower brightness level than the first luminance control signal is for setting the luminance of the display area, the comparator/selector is adapted to supply to the scan driver the second luminance control signal and to supply to the first luminance control unit a first selection signal for controlling the first luminance control unit to be turned off.

4. The organic light emitting display device according to claim 1, wherein, when the first luminance control signal is for setting a luminance of the display area to a lower brightness level than the second luminance control signal is for setting the luminance of the display area, the comparator/selector is adapted to supply to the scan driver the first luminance control signal and to supply to the second luminance control unit a second selection signal for controlling the second luminance control unit to be turned off.

5. The organic light emitting display device according to claim 1, wherein, when the first luminance control signal is for setting a luminance of the display area to a lower brightness level than the second luminance control signal is for setting the luminance of the display area, the comparator/selector is adapted to supply to the scan driver the first luminance control signal and to supply to the second luminance control unit a second selection signal for controlling the second luminance control unit to be turned off, and wherein, when the second luminance control signal is for setting the luminance of the display area to a lower brightness level than the first luminance control signal is for setting the luminance of the display area, the comparator/selector is adapted to supply to the scan driver the second luminance control signal and to supply to the first luminance control unit a first selection signal for controlling the first luminance control unit to be turned off.

6. The organic light emitting display device according to claim 1, wherein the first luminance control unit comprises:

an analog/digital converter for converting the optical sensor signal, which is an analog signal, into a digital sensor signal;

a first lookup table for storing information of a width of a first brightness control signal corresponding to the digital sensor signal;

a first controller for extracting the information of the width of the first brightness control signal, corresponding to the digital sensor signal, from the first lookup table; and a first luminance control signal generation unit for generating the first luminance control signal in accordance with the information of the width of the first brightness control signal extracted from the first controller.

7. The organic light emitting display device according to claim 6, wherein the width of the first brightness control signal is set so that a luminance of the display area is reduced when the digital sensor signal corresponds to a dark brightness level of the ambient light.

8. The organic light emitting display device according to claim 6, wherein the first luminance control unit further comprises a first switch unit for transmitting the optical sensor signal, supplied from the optical sensor, to the analog/digital converter, or interrupting transmission of the optical sensor signal to the analog/digital converter according to a first selection signal supplied from the comparator/selector.

9. The organic light emitting display device according to claim 1, wherein the second luminance control unit comprises:

a data sum-up unit for summing up the data of one frame to generate sum-up data and for generating, as control data, at least two bit values including most significant bits of the sum-up data;

a second lookup table for storing information of a width of a second brightness control signal corresponding to the control data;

a second controller for extracting the information of the width of the second brightness control signal corresponding to the control data from the second lookup table; and a second luminance control signal generation unit for generating the second luminance control signal in accordance with the information of the width of the second brightness control signal extracted from the second controller.

10. The organic light emitting display device according to claim 9, wherein the width of the second brightness control signal is set so that a luminance of the display area is decreased with an increase in value of the control data.

11. The organic light emitting display device according to claim 9, wherein the second luminance control unit further comprises a second switch unit for transmitting the data of one frame to the data sum-up unit or interrupting transmission of the data to the data sum-up unit according to a second selection signal supplied from the comparator/selector.

12. A method for driving an organic light emitting display device having a display area comprising a plurality of pixels, the method comprising:

generating an optical sensor signal corresponding to brightness of ambient light;

generating a first luminance control signal for controlling a pulse width of a light emission control signal in accordance with the optical sensor signal;

generating a second luminance control signal for controlling the pulse width of the light emission control signal in accordance with data of one frame of an image;

comparing the first luminance control signal with the second luminance control signal; and selecting one of the first luminance control signal or the second luminance control signal to control a luminance of the display area.

13. The method for driving the organic light emitting display device according to claim 12, further comprising controlling the luminance of the display area in accordance with the selected one of the first luminance control signal or the second luminance control signal, wherein the selecting the one of the first luminance control signal or the second luminance control signal to control the luminance of the display area comprises selecting the one of the first luminance control signal or the second luminance control signal that reduces the luminance of the display area more.

14. A method for driving an organic light emitting display device having a display area comprising a plurality of pixels, the method comprising:

generating an optical sensor signal corresponding to brightness of ambient light;

generating a first luminance control signal for controlling a pulse width of a light emission control signal in accordance with the optical sensor signal;

generating a second luminance control signal for controlling the pulse width of the light emission control signal in accordance with data of one frame of an image;

comparing the first luminance control signal with the second luminance control signal;

selecting one of the first luminance control signal or the second luminance control signal to control a luminance of the display area; and controlling the luminance of the display area in accordance with the selected one of the first luminance control signal or the second luminance control signal, wherein the selecting the one of the first luminance control signal or the second luminance control signal to control the luminance of the display area comprises selecting the one of the first luminance control signal or the second luminance control signal that reduces the luminance of the display area more, and wherein the generating the first luminance control signal comprises:

converting the optical sensor signal into a digital sensor signal;

extracting information of a width of a first brightness control signal corresponding to the digital sensor signal; and generating the first luminance control signal in accordance with the extracted information of the width of the first brightness control signal.

15. A method for driving an organic light emitting display device having a display area comprising a plurality of pixels, the method comprising:

generating an optical sensor signal corresponding to brightness of ambient light;

generating a first luminance control signal for controlling a pulse width of a light emission control signal in accordance with the optical sensor signal;

generating a second luminance control signal for controlling the pulse width of the light emission control signal in accordance with data of one frame of an image;

comparing the first luminance control signal with the second luminance control signal;

selecting one of the first luminance control signal or the second luminance control signal to control a luminance of the display area; and controlling the luminance of the display area in accordance with the selected one of the first luminance control signal or the second luminance control signal, wherein the selecting the one of the first luminance control signal or the second luminance control signal to control the luminance of the display area comprises selecting the one of the first luminance control signal or the second luminance control signal that reduces the luminance of the display area more, and wherein the generating the second luminance control signal comprises:

summing up the data of one frame to generate sum-up data;

generating control data corresponding to the sum-up data;

extracting information of a width of a second brightness control signal corresponding to the control data; and generating the second luminance control signal in accordance with the extracted information of the width of the second brightness control signal.

16. An organic light emitting display device for displaying an image and having a plurality of scan lines and a plurality of light emission control lines, the organic light emitting display comprising:

a display area including a plurality of pixels coupled to the scan lines and the light emission control lines;

a scan driver electrically coupled to the display area through the scan lines and the light emission control lines;

an optical sensor for generating an optical sensor signal corresponding to brightness of ambient light;

a comparator/selector for comparing a first luminance control signal with a second luminance control signal and for selecting one of the first luminance control signal or the second luminance control signal for output to the scan driver;

a first luminance control unit for providing to the comparator/selector the first luminance control signal for controlling a pulse width of a light emission control signal in accordance with the optical sensor signal; and a second luminance control unit for providing to comparator/selector the second luminance control signal for controlling the pulse width of the light emission control signal in accordance with data of one frame of the image.

17. The organic light emitting display device according to claim 16, wherein the comparator/selector is adapted to select the one of the first luminance control signal or the second luminance control signal that reduces a luminance of the display area more.

18. The organic light emitting display device according to claim 16, wherein, when the first luminance control signal is for setting a luminance of the display area to a lower brightness level than the second luminance control signal is for setting the luminance of the display area, the comparator/selector is adapted to supply to the scan driver the first luminance control signal and to supply to the second luminance control unit a second selection signal for controlling the second luminance control unit to be turned off, and wherein, when the second luminance control signal is for setting the luminance of the display area to a lower brightness level than the first luminance control signal is for setting the luminance of the display area, the comparator/selector is adapted to supply to the scan driver the second luminance control signal and to supply to the first luminance control unit a first selection signal for controlling the first luminance control unit to be turned off.

19. The organic light emitting display device according to claim 16, wherein the first luminance control unit comprises:

an analog/digital converter for converting the optical sensor signal, which is an analog signal, into a digital sensor signal;

a first lookup table for storing information of a width of a first brightness control signal corresponding to the digital sensor signal;

a first controller for extracting the information of the width of the first brightness control signal, corresponding to the digital sensor signal, from the first lookup table; and a first luminance control signal generation unit for generating the first luminance control signal in accordance with the information of the width of the first brightness control signal extracted from the first controller, and wherein the second luminance control unit comprises:

a data sum-up unit for summing up the data of one frame to generate sum-up data and for generating, as control data, at least two bit values including most significant bits of the sum-up data;

a second lookup table for storing information of a width of a second brightness control signal corresponding to the control data;

a second controller for extracting the information of the width of the second brightness control signal corresponding to the control data from the second lookup table; and a second luminance control signal generation unit for generating the second luminance control signal in accordance with the information of the width of the second brightness control signal extracted from the second controller.

20. The organic light emitting display device according to claim 19, wherein the first luminance control unit further comprises a first switch unit for transmitting the optical sensor signal, supplied from the optical sensor, to the analog/digital converter, or interrupting transmission of the optical sensor signal to the analog/digital converter according to a first selection signal supplied from the comparator/selector, and wherein the second luminance control unit further comprises a second switch unit for transmitting the data of one frame to the data sum-up unit or interrupting transmission of the data to the data sum-up unit according to a second selection signal supplied from the comparator/selector.

* * * * *